US005234463A

United States Patent [19]

Sando et al.

[11] Patent Number: 5,234,463

[45] Date of Patent: Aug. 10, 1993

[54] METHOD FOR DESIZING AND SCOURING OF A CLOTH

[75] Inventors: Yoshiteru Sando; Eiichi Nakano; Hiroshi Ishidoshiro; Koji Sando, all of Wakayama, Japan

[73] Assignee: Sando Iron Works Co., Ltd., Wakayama, Japan

[21] Appl. No.: 756,486

[22] Filed: Sep. 9, 1991

[30] Foreign Application Priority Data

Sep. 19, 1990 [JP] Japan ..... 2-249219

[51] Int. Cl.[5] ..... D06L 3/08

[52] U.S. Cl. ..... 8/138; 8/139; 8/137.5; 8/108.1

[58] Field of Search ..... 8/138, 139, 137.5, 108.1

[56] References Cited

U.S. PATENT DOCUMENTS 2,173,040 9/1939 Muller ..... 8/139

3,281,202 10/1966 Helmick et al. ..... 8/139

4,106,901 8/1978 Bishop et al. ..... 8/139

4,912,791 4/1990 Streit et al. ..... 8/137

FOREIGN PATENT DOCUMENTS 1-183573 7/1989 Japan .

*Primary Examiner*—Prince Willis, Jr.
*Assistant Examiner*—Alan D. Diamond
*Attorney, Agent, or Firm*—McAulay Fisher Nissen Goldberg & Kiel

[57] ABSTRACT

A method for desizing and scouring of a long length of cloth comprising desizing a cloth washed with hot water, and then subjecting the cloth thus washed successively to soaking with a hot alkaline sodium chlorite solution, immersing in a hot acid solution with a pH of 2–4, then to soaking with a caustic soda solution, and finally to the wet heat treatment under the ordinary pressure.

1 Claim, 1 Drawing Sheet

METHOD FOR DESIZING AND SCOURING OF A CLOTH

BACKGROUND OF THE INVENTION

1. Field of the Invention

The present invention relates to a method for desizing and scouring of a long length of cloth comprising cotton or cotton-mixing yarns continuously in a short time.

2. Description of the Related Arts

The conventional method for continuous desizing and scouring of a long length of cotton cloth or a cloth containing cotton produced commercially is, to subject the cloth, after washing with the use of hot water, to desizing and scouring in two steps. A one step process, in which desizing and scouring is done in one step, is also applied in some instances. However, in these processes, after the treatment with the use of a treating chemical, the cloth is squeezed with the use of a mangle, and then scouring is done by steaming or by the combined use of steaming and the treatment in a solution. Moreover, in these conventional processes, since the treatment is done by piling up 4000–6000m of a cloth in a limited size apparatus, it needs a long time of 45–60 minutes in the treatment to obtain a uniform product. Particularly, in the case of a high density cloth and a cloth with hard twisted yarns, there occurs unavoidably treating creases and unevenness of the product. Accordingly, a continuous rapid desizing and scouring by the use of a high pressure steamer has also been applied in some instances.

Thus, in the conventional desizing and scouring method under the ordinary pressure, since a large amount of a cloth is piled up in a chamber with a limited size, there occurs an uneven temperature distribution and a deficiency of water unavoidably, and as a result it is necessary to ensure a long treating time of 45–60 minutes in order to obtain a uniform product. As a result, for the purpose not only to shorten the treating time but also to correct the irregularity of the treatment, it is necessary to use a concentrated treating chemical, and accordingly the use of an excess of the treating chemicals is unavoidable.

Further, at the present situation, for the purpose to elevate the productivity, the addition of an aftertreatment process or an apparatus thereof is under development for increasing the speed of the treating process of a cloth. However, in accordance with the speed up of the aftertreatment, a high speed desizing and scouring is of course necessitated.

SUMMARY OF THE INVENTION

Under such circumstances, the object of the present invention is to offer a method for desizing and scouring of a long length of cloth continuously and speedily by the wet heat treatment under the ordinary pressure. While the present inventors have recently proposed the methods for the pretreatment of a cloth in Japanese Patent Applications Sho 1-183573, Sho 2-074666 and Sho 1-298272, the present invention is further to improve these inventions.

To describe the present invention practically, in desizing and scouring a cotton cloth or a cloth containing cotton, the soluble sizing chemical adhering to the cloth is removed by hot water treatment, and then the cloth is subjected successively to desizing treatment→hot alkaline sodium chlorite solution treatment→hot weak acidic solution treatment→alkaline solution treatment, and finally wet heat treatment of the resultant cloth is done under the ordinary pressure.

Namely, a cloth treated with a sizing chemical is washed in hot water at a temperature of 80°–90° C. for about 30–60 seconds and steamed by the addition of 0.5–1% of desizing chemical such as an enzyme for 30–60 seconds, and after the addition of a hot solution containing 0.1–0.2% of alkaline sodium chlorite at a temperature of 80°–90° C., the resultant cloth is treated in an acidic solution with a pH of 2–4 for 10–20 seconds at 80°–90° C., and finally the cloth thus treated is subjected to wet heat treatment with the addition of 1–1.5% sodium hydroxide solution in a wet heat treating chamber under the ordinary pressure for 60 seconds at a temperature in the range from 92° C. to 100° C.

Therefore, according to this method, since the cloth is treated with an alkaline solution containing sodium chlorite prior to the alkaline scouring, the saponification of the fatty matter contained in the cloth becomes easy, and accordingly a desized and scoured cloth with a similar quality as in the conventional process can easily be obtained in an alkaline scouring treatment in a short time of about 60 seconds in an ordinary pressure wet heat treating chamber. As a result, the transport means with the use of rolls can satisfactorily be applied by eliminating such defects as the use of U-box and J-box for the use of loading and transporting means in the conventional arts, and accordingly, there is no danger of receiving piling load, and it is possible to supply sufficient amount of water and heat energy uniformly to the cloth. In the present inventive method, therefore, there is entirely no occurrence of unevenness in the treatment, and moreover, the consumption of chemicals can be spared remarkably as compared with the conventional methods.

As above explained, in the present method, the continuous desizing and scouring of a long cloth can satisfactorily be done by the wet heat treatment in a short time of about 60 seconds under the atmosphere in the ordinary pressure. Since the treating time can thus be shortened remarkably, it is possible to perform the treatment in a small size treating chamber, and moreover, since the use of a steamer fitted with guide rolls for transporting the cloth continuously through the reaction chamber can satisfactorily be done, it is possible to prevent the necessity of piling up the cloth in the chamber. Thus, a desized and scoured cloth with superior quality can be obtained in a short time in the present invention, and the effect of the present invention is quite distinguished.

DETAILED DESCRIPTION OF THE PREFERRED EMBODIMENTS

Figure 1:
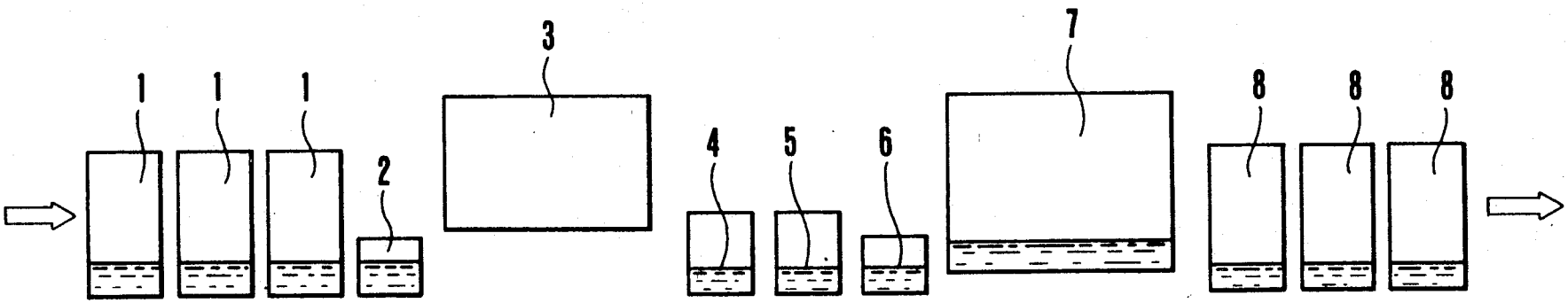
FIG. 1 is a drawing to explain the constitution of an apparatus for executing the present inventive desizing and scouring of a long length of cloth continuously, in which 1 represents a washing tank, 2 is a desizing tank, 3 is a steamer, 4, 5 and 6 are to denote respectively sodium chlorite solution, dilute aqueous acid solution and caustic soda solution, 7 is a wet heat treating chamber under the ordinary pressure and 8 represents a washing tank.

An example of the present invention will be described in the following so as to explain the embodiment of the invention more in detail with reference to the drawings showing the apparatus for carrying out the present method.

A cloth to be treated is a cotton cloth with a dimension of $$\frac{40 \times 40}{134 \times 110}.$$

In the first place, the cloth is washed with hot water at a temperature of 70°-80° C. for about 60 seconds in a plurality of washing tanks 1 for removing soluble impurities adhering to the cloth. The cloth thus washed is then guided through a solution containing 0.5-1.0% of an enzyme as a desizing chemical at a temperature of 40°-60° C. in a desizing tank 2 for immersing the cloth therein for about 10 seconds. The cloth thus containing said desizing chemical is then subjected to steaming for about 60 seconds in a steamer 3 in which wet heat at a temperature of 100°-103° C. is maintained.

The resultant cloth thus treated is passed successively through a hot solution 4 containing 0.1-0.2% of alkaline sodium chlorite at 80°-90° C. for 10 seconds, a dilute sulfuric acid solution 5 of which pH is controlled to 2-3 at about 90° C. for about 20 seconds, and then a caustic soda solution 6 with a concentration of 1-1.5% at 50°-60° C. for 10 seconds respectively for the treatment with these solutions. Then, the cloth thus treated is subjected to wet heat treatment in a wet heat treating chamber 7 under the ordinary pressure for about 60 seconds at a temperature of about 95° C., and finally the cloth is washed in a plurality of washing tanks 8 in which hot water is maintained at a temperature of 60°-90° C. Thus, the desizing and scouring of a long length of cloth continuously in object is finished in a short time eminently.

In this way since a hot alkaline sodium chlorite solution treatment is done previously, the alkaline scouring treatment under wet heat at the ordinary pressure can be done in a short time of about 60 seconds, and accordingly the treating time in the conventional desizing and scouring, which needs 45-60 minutes, can remarkably be shortened in the present invention. Therefore it is possible to make compact the reaction tank in which the desizing and scouring treatments are conducted and the cloth can be transferred on the rolls free from the pile load so that the resultant cloth has excellent quality without wrinkles. Further, as obvious from this example, the necessary amount of the treating chemicals, for example the caustic soda, can be reduced to about ¼ to 1/5 of the amount required with conventional art.

What is claimed is:

1. A method for desizing and scouring a long length of cloth comprising desizing for 30 to 60 seconds a cloth washed with hot water, and then subjecting the cloth thus washed successively to soaking with a hot alkaline sodium chloride solution, immersing said cloth in a hot acidic solution with a pH of from 2 to 4, for 10 to 20 seconds, soaking said cloth with a caustic soda solution, and finally subjecting said cloth to a wet treatment under ordinary pressure.

* * * * *